US009765499B2

(12) United States Patent
Gorman et al.

(10) Patent No.: US 9,765,499 B2
(45) Date of Patent: Sep. 19, 2017

(54) BOOM ASSIST MANAGEMENT FEATURE

(71) Applicant: Caterpillar Inc., Peoria, IL (US)

(72) Inventors: Corey Lee Gorman, Peoria, IL (US); Adam Martin Nackers, East Peoria, IL (US); John J. Krone, Peoria, IL (US); Mahmoud M. Tobaa, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 346 days.

(21) Appl. No.: 14/520,487

(22) Filed: Oct. 22, 2014

(65) Prior Publication Data

US 2016/0115669 A1 Apr. 28, 2016

(51) Int. Cl.

| | |
|---|---|
| ***E02F 3/00*** | (2006.01) |
| ***E02F 3/43*** | (2006.01) |
| ***E02F 3/32*** | (2006.01) |
| ***E02F 3/42*** | (2006.01) |
| ***E02F 9/20*** | (2006.01) |
| ***E02F 9/22*** | (2006.01) |

(52) U.S. Cl.

CPC ..... *E02F 3/435* (2013.01); *E02F 3/32* (2013.01); *E02F 3/425* (2013.01); *E02F 3/437* (2013.01); *E02F 9/2004* (2013.01); *E02F 9/2012* (2013.01); *E02F 9/2203* (2013.01); *E02F 9/2228* (2013.01); *E02F 9/2285* (2013.01)

(58) Field of Classification Search

CPC ... E02F 3/32; E02F 3/435; E02F 3/437; E02F 9/2004; E02F 9/2214; E02F 9/2228

See application file for complete search history.

(56) References Cited

U.S. PATENT DOCUMENTS

| | | | | |
|---|---|---|---|---|
| 5,065,326 | A | 11/1991 | Sahm | |
| 7,979,181 | B2 | 7/2011 | Clark et al. | |
| 8,655,558 | B2 | 2/2014 | Kawasaki et al. | |
| 8,744,695 | B2 | 6/2014 | Kanayama et al. | |
| 2009/0071144 | A1 | 3/2009 | Ma et al. | |
| 2009/0218112 | A1 | 9/2009 | Mintah et al. | |
| 2010/0017074 | A1* | 1/2010 | Verkuilen | E02F 9/265 701/50 |
| 2011/0308242 | A1* | 12/2011 | Pfaff | E02F 9/2242 60/327 |

(Continued)

*Primary Examiner* — Thomas G Black
*Assistant Examiner* — Peter D Nolan
(74) *Attorney, Agent, or Firm* — James S. Bennin

(57) ABSTRACT

A hydraulic control system is disclosed for an excavation machine including a tool linkage system. The hydraulic control system may have a first actuator configured to move a first link of the tool linkage system in response to input from an operator of the excavation machine, and a pressure sensor configured to generate a signal indicative of a pressure of the first actuator. The hydraulic control system may also have a second actuator configured to move a second link of the tool linkage system in response to input from the operator. In addition, the hydraulic control system may have a controller in communication with the pressure sensor, the first actuator, and the second actuator. The controller may be configured to automatically affect operation of the first actuator based on the pressure signal at times when movement of the second actuator is being requested by the operator and movement of the first actuator is being requested by the operator at a level less than a threshold.

20 Claims, 3 Drawing Sheets

(56) References Cited

U.S. PATENT DOCUMENTS

| | | | | |
|---|---|---|---|---|
| 2011/0318157 | A1* | 12/2011 | Okamura | E02F 9/2207 414/687 |
| 2012/0130599 | A1* | 5/2012 | Faivre | E02F 9/265 701/50 |
| 2012/0198831 | A1 | 8/2012 | Kodaka et al. | |
| 2012/0216517 | A1 | 8/2012 | Peterson et al. | |
| 2012/0246981 | A1 | 10/2012 | Magaki et al. | |
| 2012/0253528 | A1* | 10/2012 | Wan | B66C 13/066 700/283 |
| 2012/0323451 | A1 | 12/2012 | Shatters et al. | |
| 2012/0324875 | A1* | 12/2012 | Edler | E02F 9/123 60/327 |
| 2013/0000289 | A1* | 1/2013 | Zhang | F15B 1/02 60/327 |
| 2013/0004280 | A1* | 1/2013 | Zhang | E02F 9/123 414/687 |
| 2013/0034419 | A1 | 2/2013 | Tsukane | |
| 2013/0115035 | A1* | 5/2013 | Saotome | E02F 9/2239 414/687 |
| 2013/0312399 | A1* | 11/2013 | Hiraku | F15B 15/18 60/422 |
| 2014/0196448 | A1* | 7/2014 | Matsuzaki | F15B 11/165 60/459 |
| 2015/0322649 | A1* | 11/2015 | Fleischmann | A01G 23/00 701/50 |

* cited by examiner

BOOM ASSIST MANAGEMENT FEATURE

TECHNICAL FIELD

The present disclosure is directed to a hydraulic control system and, more particularly, to a hydraulic control system having boom assist.

BACKGROUND

With increased market pressure on reducing excavation machine fuel consumption and improving both the effectiveness of novice operators and the comfort for all operators, control strategies that optimize machine performance while still providing the required machine controllability are becoming more important. One particular opportunity may be associated with boom control during both digging and leveling operations. During these operations, improper boom control can lead to excessive fuel burn because either insufficient payload is acquired, the stick and/or bucket stalls during digging, or the boom cylinder head end pressure drops too low causing additional hydraulic losses. Improper boom control during the digging or leveling operations may also cause rocking or jerking of the machine, resulting in instability and discomfort of the operator.

One attempt to improve the digging efficiency of an excavation machine is disclosed in U.S. Pat. No. 7,979,181 ("the '181 patent") that issued to Clark et al. The '181 patent discloses a machine that automates the digging cycle by controlling the bucket and boom velocity dependent on the relative hardness of the work material. An electronic signal queries whether the bucket tip is at a desired dig angle. If not, the control initiates a boom-up command to assist in curling the bucket. The control of the '181 patent automates the speed of the bucket and the boom depending on the relative hardness of the material.

Although the '181 patent may provide some improvements on the digging cycle, it may also have some drawbacks. Specifically, the automated system may lack broad applicability to a manned machine. The automated system also may not benefit a novice operator or improve the comfort and safety of the operator.

The hydraulic control system of the present disclosure solves one or more of the problems set forth above and/or other problems in the art.

SUMMARY

In one aspect, the present disclosure is directed to a hydraulic control system for an excavation machine having a tool linkage system. The hydraulic control system may include a first actuator configured to move a first link of the tool linkage system in response to input from an operator of the excavation machine, and a pressure sensor configured to generate a pressure signal indicative of a pressure of the first actuator. The hydraulic control system may also include a second actuator configured to move a second link of the tool linkage system in response to input from the operator. In addition, the hydraulic control system may include a controller in communication with the pressure sensor, the first actuator, and the second actuator. The controller may be configured to automatically affect operation of the first actuator based on the pressure signal at times when movement of the second actuator is being requested by the operator and movement of the first actuator is being requested by the operator at a level less than a threshold.

In another aspect, the present disclosure is directed to a machine having a frame, an engine supported by the frame, a linkage system, and a hydraulic control system. The linkage system may include a boom, a stick pivotally connected to the boom, and a bucket pivotally connected to the stick. The hydraulic control system may include a tank containing a hydraulic fluid, and a pump powered by the engine to pressurize hydraulic fluid. The hydraulic system may also include a boom actuator configured to receive pressurized fluid from the pump and to move the boom, and a pressure sensor configured to generate a pressure signal indicative of a pressure of the boom actuator. The hydraulic system may further include a stick actuator configured to receive pressurized fluid from the pump and move the stick, and a controller in communication with the pressure sensor, the boom actuator, and the stick actuator. In addition, the hydraulic system may include a first operator interface device configured to control pressurized fluid directed to the boom actuator based on operator input, and a second operator interface device configured to control pressurized fluid directed to the stick actuator based on operator input. The controller may be configured to automatically affect operation of the boom actuator based on the pressure signal at times when movement of the stick actuator is being requested by an operator of the machine and movement of the boom actuator is being requested by the operator at a level less than a threshold In yet another aspect, the present disclosure is directed to a method of operating an excavation machine. The method may include receiving a first operator input indicative of desired movement of a first link of the excavation machine, and receiving a second operator input indicative of desired movement of a second link of the excavation machine. The method may further include monitoring a pressure of a first actuator associated with movement of the first link, and automatically controlling the first actuator based on the monitored pressure during movement of the second link when a first operator input is less than a threshold.

DETAILED DESCRIPTION

Figure 1:
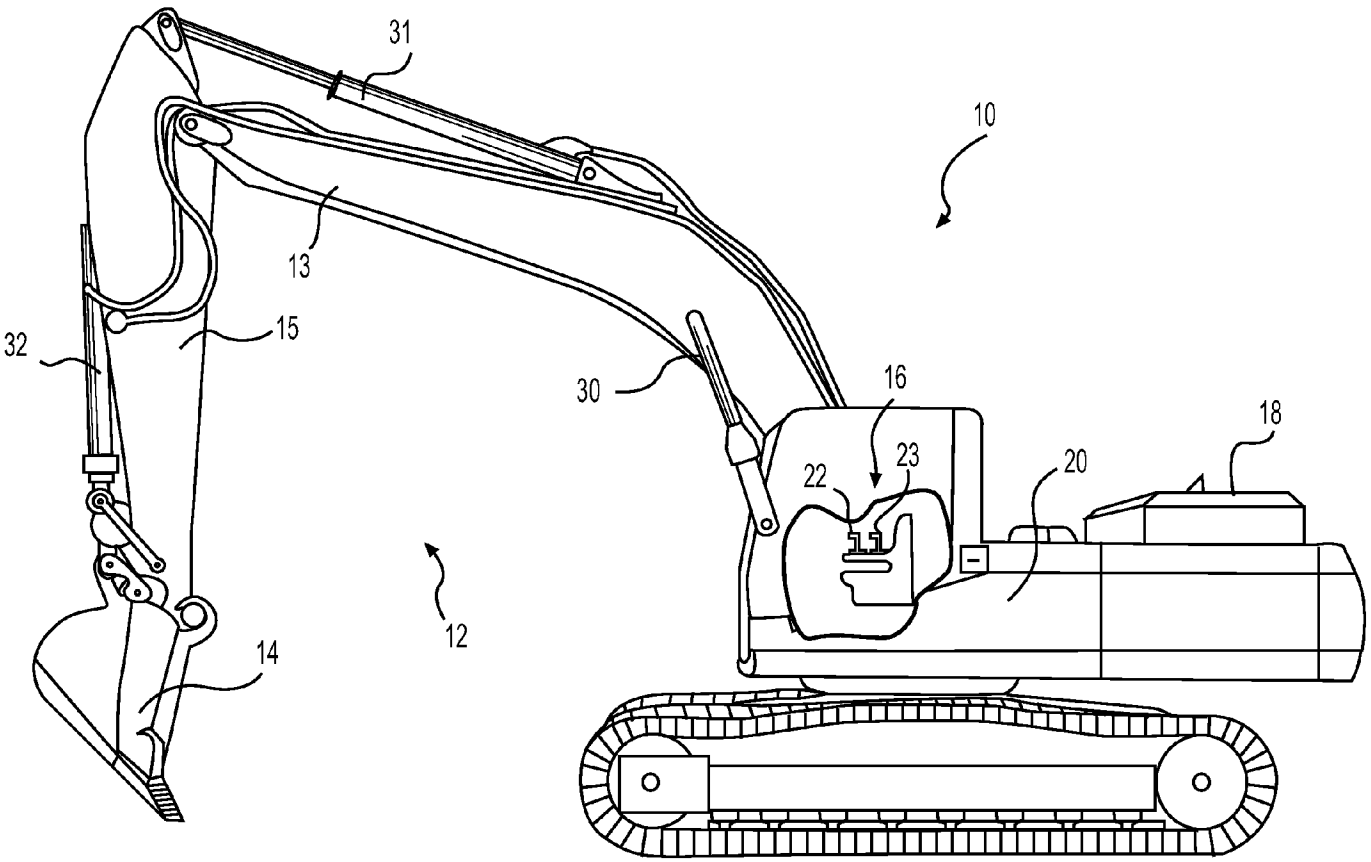
FIG. 1 is an isometric illustration of an exemplary disclosed machine.

FIG. 1 illustrates an exemplary machine 10 having multiple systems and components that cooperate to dig and level. In the depicted example, machine 10 is a hydraulic excavator. It is contemplated, however, that machine 10 could alternatively embody another excavation or material handling machine, such as a backhoe, a front shovel, a dragline excavator, a crane, or another similar machine. Machine 10 may include, among other things, a linkage system 12 configured to move a work tool 14 between a dig location within a trench or at a pile, and a dump location. Machine 10 may also include an operator interface 16 for manual control of linkage system 12. It is contemplated that machine 10 may perform operations other than digging and levelling, if desired, such as craning, loading, and material handling.

Linkage system 12 may include a boom 13 that is vertically pivotal relative to a frame 20 of machine 10 by a pair of adjacent, double-acting, boom actuators 30 (only one shown in FIG. 1). Linkage system 12 may also include a stick 15 that is vertically pivotal relative to boom 13 by a single, double-acting, stick actuator 31. Linkage system 12 may further include a double-acting, tool actuator 32 that is operatively connected to work tool 14 to tilt work tool 14 vertically relative to stick 15. It is contemplated that a greater or lesser number of fluid actuators may be included.

Numerous different work tools 14 may be attachable to stick 15 and controllable via operator interface 16. Work tool 14 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Work tool 14 may be configured to pivot, rotate, slide, swing, lift, or move relative to machine 10 in any manner known in the art.

Operator interface 16 may be configured to receive input from a machine operator indicative of a desired work tool 14 movement. Specifically, operator interface 16 may include a first operator interface device 22, a second operator interface device 23, and an optional third (or more) operator interface device (not shown). Operator interface devices 22, 23 may be multi-axis joysticks located on each side of an operator station. Operator interface devices 22, 23 may be proportional-type controllers configured to position and/or orient work tool 14, and to produce interface device position signals indicative of a desired movements of work tool 14. It is contemplated that additional and/or different operator interface devices may be included within operator interface 16 such as, for example, wheels, knobs, push-pull devices, switches, pedals, and other operator interface devices known in the art.

First operator interface device 22 may control movement of boom 13, while second operator interface device 23 may control movement of stick 15. For example, pulling back first operator interface device 22 may raise boom 13, and pushing forward first operator interface device 22 may lower boom 13. Similarly, pulling back second operator interface device 23 may move stick 15 in, and pushing forward second operator interface device 23 may push stick 15 out. First operator interface device 22 and/or second operator interface device 23 may alternatively be inverted, if desired. Movement of work tool 14 may be controlled by left and right manipulation of either of first operator interface device 22 or second operator interface device 23. Manipulating one of the operator interface devices 22, 23 to the left may cause curling of work tool 14 and to the right may cause racking of work tool 14, or vice versa. Work tool 14 may, alternatively, be actuated by the optional third interface device (not shown).

Figure 2:
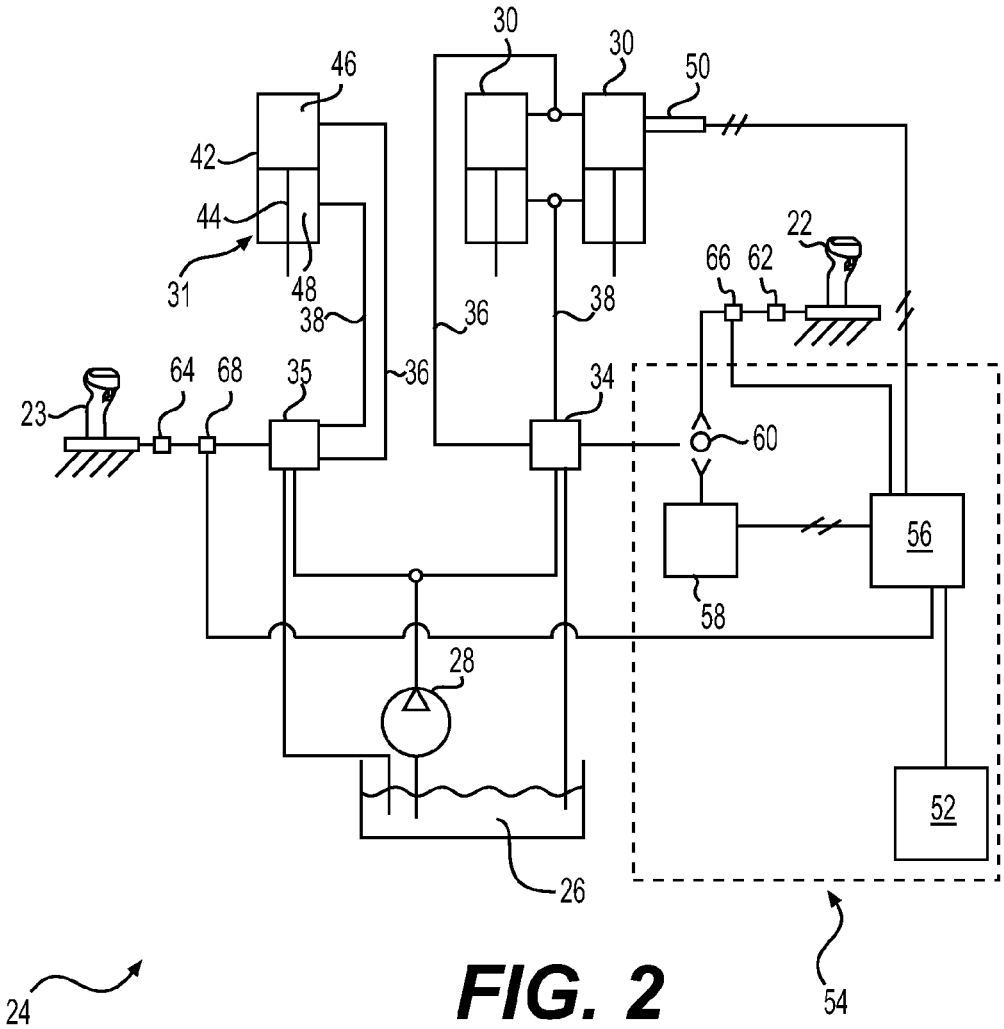
FIG. 2 is a schematic illustration of an exemplary disclosed hydraulic circuit that may be used in conjunction with the machine of FIG. 1.

As illustrated in FIG. 2, machine 10 may include a hydraulic circuit 24 having a plurality of fluid components that cooperate to move work tool 14. Specifically, hydraulic circuit 24 may include a tank 26 holding a supply of fluid, and a source 28 configured to pressurize the fluid and to direct the pressurized fluid to actuators 30-32. While FIG. 1 depicts boom, stick and tool actuators, identified as 30-32, for the purposes of simplicity, the hydraulic schematic of FIG. 2 depicts only boom actuators 30 and stick actuator 31. Hydraulic circuit 24 may include, among other things, a boom control valve 34 and a stick control valve 35 that regulate fluid flow from source 28 to boom actuators 30 and to stick actuator 31, respectively. It is contemplated that hydraulic circuit 24 may include additional and/or different components such as, for example, accumulators, restrictive orifices, check valves, pressure relief valves, makeup valves, pressure-balancing passageways, temperature sensors, tool recognition devices, and other components known in the art. The hydraulic circuit 24 of FIG. 2 may also be modified by the addition of tool actuator 32 in a configuration similar to stick actuator 31, or by replacing stick actuator 31 with tool actuator 32.

Tank 26 may constitute a reservoir configured to hold a supply of fluid. The fluid may include, for example, a dedicated hydraulic oil, an engine lubrication oil, a transmission lubrication oil, or any other fluid known in the art. One or more hydraulic circuits within machine 10 may draw fluid from and return fluid to tank 26. It is also contemplated that hydraulic circuit 24 may be connected to multiple separate fluid tanks.

Source 28 may be configured to produce a flow of pressurized fluid and may include a pump such as, for example, a variable displacement pump, a fixed displacement pump, or any other source of pressurized fluid known in the art. Source 28 may be driven by a power source 18 of machine 10 by, for example, a countershaft (not shown), a belt (not shown), an electrical circuit (not shown), or in any other suitable manner. Alternatively, source 28 may be indirectly connected to power source 18 via a torque converter (not shown), a gear box (not shown), or in any other manner known in the art. It is contemplated that multiple sources of pressurized fluid may be interconnected to supply pressurized fluid to hydraulic circuit 24.

Boom control valve 34 and stick control valve 35 may regulate flows of pressurized fluid from source 28 to actuators 30, 31 and from actuators 30, 31 to tank 26. This fluid regulation may function to cause a lifting or lowering movement of work tool 14 about the associated horizontal axis (referring to FIG. 1) in accordance with an operator request received via operator interface 16.

Actuators 30-32 may each embody a linear actuator having a tube 42 and a piston assembly 44 arranged to form a head-end chamber 46 and a rod-end chamber 48 within the housing. The Chambers 46, 48 may be selectively supplied with pressurized fluid and drained of the pressurized fluid to cause piston assembly 44 to displace within the tubular housing, thereby changing an effective length of actuators 30-32. The flow rate of fluid into and out of the chambers 46, 48 may relate to a velocity of actuators 30-32, while a pressure differential between the chambers 46, 48 may relate to a force imparted by actuators 30-32 on the associated linkage members. The expansion and retraction of actuators 30-32 may function to lift and lower work tool 14.

Control valves 34, 35 may be connected to their respective actuators 30, 31 by way of a head-end passage 36 and a rod-end passage 38. Based on an operating position of control valves 34, 35, one of head- and rod-end passages 36, 38 may be connected to source 28 via control valves 34, 35, while the other of head- and rod-end passages 36, 38 may be simultaneously connected to tank 26 via control valves 34, 35, thereby creating the pressure differential across piston assembly 44 within boom and stick actuators 30, 31 that causes extension or retraction thereof.

First and second operator interface devices 22, 23 may be pilot type controllers, having first and second pilot valves 62, 64 that direct pilot fluid to move control valves 34, 35, respectively. The pilot fluid may manipulate control valves 34, 35 to allow fluid to pass from source 28 to actuators 30, 31, or from actuators 30, 31 to tank 26, thereby affecting movement of work tool 14. It is contemplated that the pilot pressure directed by first pilot valve 62 may be required to be greater than a threshold in order to manipulate boom control valve 34.

A control system 54 may be associated with hydraulic circuit 24 to help regulate movements of actuators 30-32 in response to input received from first operator interface device 22 and second operator interface device 23. Control system 54 may include a plurality of pressure sensors 50, 66, 68, a travel switch 52, a controller 56, an override valve 58, and a shuttle valve 60. In response to signals indicating movement of boom 13 and stick 15, controller 56 may operate the boom assist feature by selectively activating override valve 58 to automatically initiate movements of boom control valve 34.

A boom sensor 50 may be associated with boom actuator 30 and configured to generate pressure signals indicative of a pressure of fluid within boom actuator 30. In the disclosed embodiment, boom sensor 50 may be disposed at head-end chamber 46 of boom actuator 30. It is contemplated, however, that boom sensor 50 may alternatively or additionally be disposed at the rod-end chamber 48 of boom actuator 30. Signals from boom sensor 50 may be directed to controller 56 for use in regulating operation of boom actuator 30.

First and second pilot valve sensors 66, 68 may be associated with first and second pilot valves 62, 64 and configured to generate pressure signals indicative of a pressure of fluid created by first and second operator interface devices 22, 23. Signals from first and second pilot valve sensors 66, 68 may be directed to controller 56 for use in regulating operation of boom actuator 30.

Travel switch 52 may be configured to determine whether machine 10 is in a travel mode. Travel switch 52 may be associated with any component of machine 10 that would indicate that machine 10 is in a travel mode. For example, travel switch 52 may be associated with a pressure sensor associated with a track motor (not shown) or a speed sensor associated with a final drive (not shown) of machine 10. Signals from 52 may be directed to controller 56 for use in regulating operation of boom actuator 30.

Controller 56 may be configured to receive the signals from boom sensor 50, first and second pilot valve sensors 66, 68, and travel switch 52 in order to generate pilot pressure to control boom. Numerous commercially available microprocessors can be configured to perform the functions of controller 56. It should be appreciated that controller 56 could readily embody a general machine controller capable of controlling numerous other functions of machine 10. It should also be appreciated that controller 56 may include one or more of an application-specific integrated circuit (ASIC), a field-programmable gate array (FPGA), a computer system, and a logic circuit configured to allow controller 56 to function in accordance with the present disclosure.

Override valve 58 may receive electric command signals from controller 56 and selectively create a hydraulic pilot pressure proportional to the command signals. This pilot pressure may be directed to boom control valve 34 in parallel with a pilot pressure from first operator interface device 22.

Shuttle valve 60 may receive the hydraulic pilot pressure created by override valve 58 and the hydraulic pilot pressure created by first operator interface device 22. Shuttle valve 60 may then compare the hydraulic pilot pressure created by first operator interface device 22 to a shuttle valve threshold. The shuttle valve threshold may have any constant or variable value, as described in more detail in the following section. In one embodiment, the shuttle valve threshold may be the value of the hydraulic pilot pressure created by override valve 58.

If the hydraulic pressure from first operator interface device 22 is higher than the shuttle valve threshold, the pilot pressure of override valve 58 may be blocked by shuttle valve 60, such that controller 56 is effectively disabled. Alternatively, if the hydraulic pressure from first operator interface device 22 is less than the shuttle valve threshold, the pilot pressure from first operator interface device 22 may be blocked, such that controller 56 may automatically affect operation of the boom actuator 30 based on movement of stick actuator 31. In another embodiment, override valve 58, and shuttle valve 60 may be replaced with a single electronically controlled valve, if desired.

Controller 56 may transmit a control signal to boom control valve 34 based on any number of conditions. In the disclosed embodiments, controller 56 generates the control signal in response to low pressure in the boom actuator 30 indicative of poor boom operation, and/or a signal from stick actuator 31 indicative of stick movement.

Figure 3:
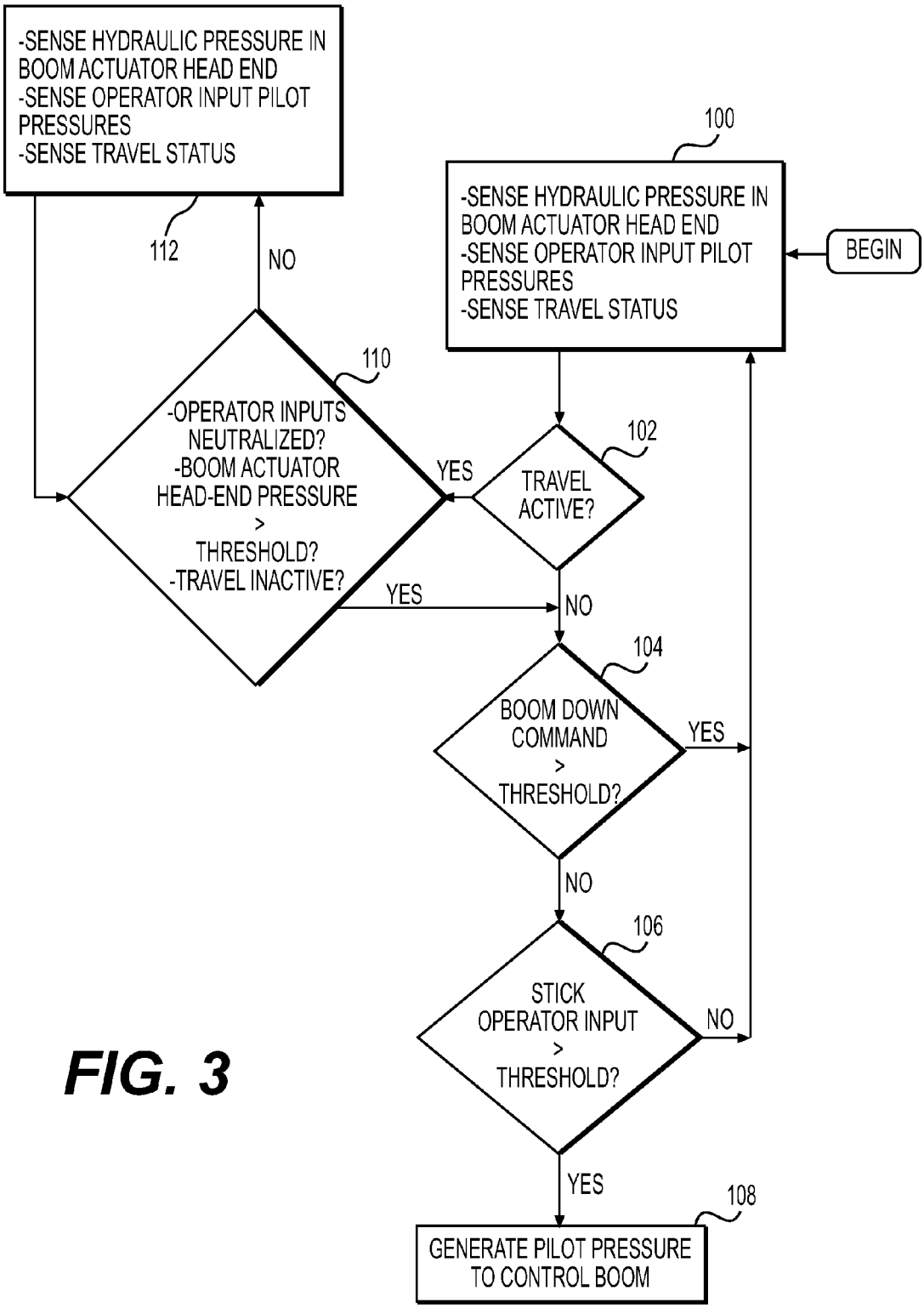
FIG. 3 is a flowchart illustrating exemplary disclosed methods of engine control that may be performed by the hydraulic circuit of FIG. 2.

FIG. 3 depicts an exemplary method of operating the disclosed excavation machine. FIG. 3 will be described in more detail in the following section.

INDUSTRIAL APPLICABILITY

The disclosed hydraulic control system may be used in any application where it is desired to increase fuel efficiency and stability during the actuation of a tool linkage system. The increased fuel efficiency and stability may be achieved by ensuring proper boom pressure during digging or leveling. For example, digging with the boom too low may cause voiding in the boom actuator head, stalling of the stick or bucket, and lifting of the machine, which results in excessive fuel burning, operator discomfort, and unsafe conditions. The disclosed hydraulic control system may correct this issue by measuring a pressure of the boom actuator during the digging and leveling, and automatically lifting the boom to the proper height. The lifting of the boom may help to ensure that the bucket makes contact at a proper angle, without stalling or heeling, and the machine body remains in stable contact with the ground. In some embodiments, the hydraulic control system may be configured to override the control of the operator when the boom is being controlled in an inefficiency or unsafe manner.

The disclosed hydraulic control system may also provide other benefits. In particular, the disclosed hydraulic control system may help to reduce the complexity of the operator interface for novice operators, by allowing the operator to concentrate on the actuation of the tool and/or stick while digging or leveling. The reduced complexity may lower the learning curve for the novice operator, increasing efficiency and safety.

In the disclosed methods, controller 56 may go through a variety of checks to determine whether the boom assist feature (controller 56 generating pilot pressure to control boom 13) should be enabled. It may be desirable for the boom assist feature to be enabled when machine 10 is not travelling, when boom 13 is not being sufficiently operated, and when stick 15 is being sufficiently operated.

After traveling, it may be desirable to disable the boom assist feature in a waiting pattern until the traveling ceases, the first and second operator interface devices 22, 23 are returned to a neutral position, and the pressure of head-end chamber 46 reaches a threshold. This waiting pattern may allow the operator to utilize linkage system 12 to support the front end of machine 10 while lowering machine 10 from higher ground to lower ground, without linkage system 12 automatically lifting out from under machine 10. Once first and second operator interface devices 22, 23 and the pressure of head-end chamber 46 reaches a threshold, linkage 12 is no longer supporting the front end of machine 10, such that it is safe to resume the boom assist feature.

Operation of hydraulic circuit 24 will now be explained with reference to FIG. 3. In step 100, controller 56 may continually receive signals from sensors 50, 66, 68 indicative of hydraulic pressure in head-end chamber 46 of boom actuator 30, and the pilot pressure pressures created by first and second operator interface devices 22, 23. Controller 56 may also receive a signal from travel switch 52. In step 102, controller 56 determines whether the machine is in a travel mode. Actuation of travel switch 52 can be determined by a pressure sensor associated with a track motor (not shown) or a speed sensor associated with a final drive (not shown).

If a travel mode is determined by travel switch 52, then controller is placed in a waiting pattern depicted in steps 110 and 112. In step 110, controller 56 makes three separate queries. Controller 56 determines whether first and second operator interface devices 22, 23 are neutralized, whether pressure of head-end chamber 46 of boom actuator 30 is greater than a threshold, and whether the travel mode is inactive. If at least one query of step 110 is not verified, then controller 56 may go to step 112 to continually sense hydraulic pressure in head-end chamber 46 of boom actuator 30, the pilot pressure pressures created by first and second operator interface devices 22, 23, and the signal from travel switch 52. Step 112 is performed until all three queries of step 110 are verified. When controller 56 determines that all three queries are verified, then controller advances to step 104.

In step 104, controller 56 may compare the signal of first pilot pressure sensor 66 to a first pilot threshold to determine whether the operator inputs a significant boom down command. If the operator inputs a boom down command higher than the first pilot threshold, then controller 56 returns to step 100. However, if there is no input higher than the first pilot threshold, then controller 56 moves onto step 106, where controller 56 may determine if the operator is inputting a stick 15 command higher than a second pilot threshold.

The thresholds of steps 104, 106, and 110 may have any constant or variable value depending on the desired degree of operator control. The thresholds of steps 104, 106, and 110 may be different or equal values. In embodiments providing increased operator control, the thresholds may be zero, such that controller 56 may only override first operator interface device 22 when there is no operator input into first operator interface device 22 and minimal operator input into second operator interface 23. Similarly, in other embodiments, the thresholds may be a constant nonzero value depending on the desired degree of operator input required to override control signal of controller 56. In yet another embodiment, the thresholds may relate to the pressure of boom sensor 50.

If the stick is being operated to the required degree in step 106, controller 56 may be enabled to generate a control signal proportional to the desired pressure change of boom actuator 30, in step 108. The signal may be transmitted to override valve 58, which generates a hydraulic pilot pressure. Override valve 58 may then transmit the hydraulic pilot pressure to shuttle valve 60.

Shuttle valve 60 may receive the hydraulic pilot pressure created by first pilot pressure valve 62 and a pilot pressure created by first operator interface device 22. Shuttle valve 60 may then compare the pilot pressure created by first operator interface device 22 to a shuttle valve threshold.

Similar to the thresholds of steps 104, 106, 110, the shuttle valve threshold may have any constant or variable value depending on the desired degree of operator control. In embodiments providing increased operator control, the shuttle valve threshold may be zero, such that controller 56 may only override first operator interface device 22 when there is no operator input into first operator interface device 22. Similarly, in other embodiments, the shuttle valve threshold may be a constant nonzero value depending on the desired degree of operator input required to override control signal of controller 56. In yet another embodiment, the shuttle valve threshold may be the pilot pressure created by override valve 58. In this embodiment, controller 56 may provide increased control since it may allow controller 56 to override first operator interface 22 at times when the operator is not inputting optimal boom 13 control.

When the pilot pressure of first operator interface device 22 is higher than the shuttle valve threshold, the operator may have control of boom 13, effectively disabling controller 56. However, when the pilot pressure created by first operator interface device 22 is lower than the shuttle valve threshold, controller 56 may automatically control the pressure of boom actuator 30 to maintain a desired range. The desired range may be between 3 and 10 MPa.

Control system 54 may alternatively be a non-pilot system. Controller 56, of this embodiment, may be electrically coupled to first operator interface device 22, and boom sensor 50 in order to affect movement of boom control valve 34. In this configuration, controller 56 may override first operator interface device 22 to automatically control boom actuator 30 when user input from first operator interface device 22 is below a non-pilot threshold and a signal indicating stick 15 movement is received. Thus, override valve 58 and shuttle valve 60 may be omitted.

It will be apparent to those skilled in the art that various modifications and variations can be made to the hydraulic control system. Other embodiments will be apparent to those skilled in the art from consideration of the specification and practice of the disclosed hydraulic control system. It is intended that the specification and examples be considered as exemplary only, with a true scope being indicated by the following claims and their equivalents.

What is claimed is:

1. A hydraulic control system for an excavation machine having a tool linkage system, the hydraulic control system comprising:

a first actuator configured to move a first link of the tool linkage system in response to a first input from an operator of the excavation machine;

a first pressure sensor configured to generate a pressure signal indicative of a pressure of the first actuator;

a second actuator configured to move a second link of the tool linkage system in response to a second input from the operator; and a controller in communication with the first pressure sensor, the first actuator, and the second actuator, wherein the controller is configured to automatically affect operation of the first actuator based on the pressure signal at times when movement of the second actuator is being requested by the operator and movement of the first actuator is being requested by the operator at a level less than a threshold.

2. The hydraulic control system of claim 1, wherein the controller is further configured to cease affecting operation of the first actuator when an input associated with a desired movement of the first actuator is received at a level above the threshold.

3. The hydraulic control system of claim 1, wherein the controller is further configured to cease affecting operation of the first actuator when no input associated with a desired movement of the second actuator is received.

4. The hydraulic control system of claim 1, wherein the threshold is a value relating to overriding an operator interface device associated with the first input.

5. The hydraulic control system of claim 1, wherein the threshold is a constant nonzero value.

6. The hydraulic control system of claim 1, wherein the controller is configured to maintain the pressure of the first actuator between about 3 MPa and about 10 MPa.

7. The hydraulic control system of claim 1, wherein the first actuator includes a boom actuator, and the second actuator includes a stick actuator.

8. The hydraulic control system of claim 1, wherein the first actuator includes a boom actuator, and the second actuator includes a tool actuator.

9. The hydraulic control system of claim 1, wherein the first pressure sensor is located at a head-end chamber of the first actuator.

10. The hydraulic control system of claim 1, further including:

a pilot valve operably configured to operate the second actuator; and a second pressure sensor configured to receive a pilot pressure from the pilot valve, and configured to send a signal to the controller to indicate when movement of the second actuator is being requested.

11. The hydraulic control system of claim 1, further including:

a first actuator control valve in communication with the first actuator; and a pilot valve moveable by an operator to provide a first pilot pressure to the first actuator control valve.

12. The hydraulic control system of claim 11, further including:

an override valve in communication with the controller; and a shuttle valve connecting the pilot valve, the override valve, and the first actuator control valve.

13. The hydraulic control system of claim 12, wherein:

the controller is configured to selectively activate the override valve to provide a second pilot pressure to the shuttle valve; and when the second pilot pressure is greater than the first pilot pressure, the shuttle valve moves to allow the controller to automatically control the first actuator control valve.

14. A machine comprising:

a frame;

an engine supported by the frame;

a linkage system connected to the frame, the linkage system including:

a boom;

a stick pivotally connected to the boom; and a bucket pivotally connected to the stick;

a hydraulic control system powered by the engine to move the linkage system, the hydraulic control system including:

a tank containing a hydraulic fluid;

a pump driven by the engine to pressurize hydraulic fluid;

a boom actuator configured to receive pressurized fluid from the pump and move the boom;

a pressure sensor configured to generate a pressure signal indicative of a pressure of the boom actuator;

a stick actuator configured to receive pressurized fluid from the pump and move the stick; and a controller in communication with the pressure sensor, the boom actuator, and the stick actuator;

a first operator interface device configured to control pressurized fluid directed to the boom actuator based on operator input; and a second operator interface device configured to control pressurized fluid directed to the stick actuator based on operator input, wherein the controller is configured to automatically affect operation of the boom actuator based on the pressure signal at times when movement of the stick actuator is being requested by an operator of the machine and movement of the boom actuator is being requested by the operator at a level less than a threshold.

15. The machine of claim 14, wherein the controller is further configured to cease affecting operation of the boom actuator when an input associated with a desired movement of the boom actuator is received at a level above the threshold.

16. The machine of claim 14, wherein the controller is further configured to cease affecting operation of the boom actuator when no input associated with a desired movement of the stick actuator is received.

17. A method of operating an excavation machine, the method comprising:

receiving a first operator input indicative of desired movement of a first link of the excavation machine;

receiving a second operator input indicative of desired movement of a second link of the excavation machine;

monitoring a pressure of a first actuator associated with movement of the first link; and automatically controlling the first actuator based on the monitored pressure during movement of the second link when the first operator input is less than a threshold.

18. The method of operating an excavation machine of claim 17, further comprising ceasing affecting operation of the first actuator when the first operator input is received above the threshold.

19. The method of operating an excavation machine of claim 17, further comprising ceasing affecting operation of the first actuator when the second operator input is not received.

20. The method of operating an excavation machine of claim 17, wherein automatically controlling the first actuator includes maintaining a pressure associated with the first link between about 3 MPa and about 10 MPa.

* * * * *